United States Patent [19]

Brust et al.

[11] Patent Number: 4,551,411

[45] Date of Patent: Nov. 5, 1985

[54] SEQUESTRANTS USED IN DIFFUSION TRANSFER ELEMENTS WITH METALLIZABLE DYES

[75] Inventors: David P. Brust; Stephen M. Neumann, both of Rochester; Edward Weissberger, Pittsford, all of N.Y.

[73] Assignee: Eastman Kodak Company, Rochester, N.Y.

[21] Appl. No.: 687,415

[22] Filed: Dec. 28, 1984

[51] Int. Cl.[4] ..... G03C 1/40; G03C 5/54

[52] U.S. Cl. ..... 430/216; 430/212; 430/214; 430/218; 430/223; 430/491

[58] Field of Search ..... 430/214, 216, 218, 219, 430/223, 491, 212

[56] References Cited

U.S. PATENT DOCUMENTS

| | | | |
|---|---|---|---|
| 3,201,246 | 8/1965 | Allen et al. | 430/491 |
| 3,617,277 | 11/1971 | Stewart | 430/218 |
| 3,856,521 | 12/1974 | Bilofsky | 430/220 |
| 4,330,616 | 5/1982 | Kurematsu et al. | 430/491 |
| 4,474,854 | 10/1984 | Bergthaller et al. | 430/214 |

FOREIGN PATENT DOCUMENTS 1240706 7/1971 United Kingdom .

*Primary Examiner*—Richard L. Schilling
*Attorney, Agent, or Firm*—Harold E. Cole

[57] ABSTRACT

Photographic assemblages are described employing metallizable redox dye-releasers and a sequestering agent which is gluconic acid, $N[CH_2—P—(O)(OH)_2]_3$ or $(HO)_2P(O)—C(CH_3)(OH)—P(O)(OH)_2$.

21 Claims, No Drawings

SEQUESTRANTS USED IN DIFFUSION TRANSFER ELEMENTS WITH METALLIZABLE DYES

This invention relates to photography, and more particularly to photographic assemblages for color diffusion transfer photography employing at least one silver halide emulsion layer and a metallizable, redox dye-releaser (RDR) and wherein a certain sequestering agent is employed, preferably in the processing composition.

Various formats for color, integral transfer elements are described in the prior art, such as U.S. Pat. Nos. 3,415,644; 3,415,645; 3,415,646; 3,647,437; 3,635,707; 3,756,815, and Canadian Patents 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

U.S. Pat. No. 3,201,246 relates to developer compositions containing a calcium sequestering agent to prevent the formation of calcium-containing sludges, scums and scales in the developer solution. Various materials are listed including $N(CH_2PO_3H_3)_3$, identified as nitrilo-N,N,N-trimethylenephosphonic acid. There is no disclosure, however, of the use of these materials in image transfer systems.

U.S. Pat. No. 4,474,854 relates to the use of certain phosphonic acid compounds in the mordant layer of an image-receiving element to improve dye metallization. The compounds used in the present invention are not disclosed in this patent, however.

U.K. Pat. No. 1,240,706 relates to a physical developer for providing a black-and-white image in materials containing an imagewise distribution of palladium nuclei. Various complexing agents are disclosed for the developer including gluconic acid. There is no disclosure, however, of the use of these materials for photographic elements employing metallizable redox dye-releasers.

U.S. Pat. Nos. 3,617,277 and 3,856,521 relate to the use of sequestering agents such as ethylenediamine tetraacetic acid (EDTA) in image transfer film units employing dye developer chemistry to provide various beneficial effects such as cleaner highlights. EDTA has also been employed in image tranfer systems utilizing redox dye releasers where it is believed to complex calcium ions inherently present in the system, thus preventing the calcium ions from interfering with dye release and diffusion.

There is a problem employing EDTA in image transfer systems utilizing metallizable, redox dye releasers, however. As the pH of the system is lowered to 5 or 6 by neutralizing layer, demetallization of the metal-dye complex on the mordant layer may occur which would produce unwanted dye hue shifts. This is probably due to EDTA being a better ligand for the metal, relative to the dye, at lower pH values.

It would be desirable to provide sequestering agents for use with a metallizable, redox dye-releaser that would improve the release rate of the metallizable dye at high pH, improve the rate of diffusion of the released metallizable dye and provide better hue stability of the released dye in its metallized form in a mordant layer.

These and other advantages are provided by a photographic assemblage in accordance with the invention which comprises:

(a) a photographic element comprising a support having thereon at least one photosensitive silver halide emulsion layer having associated therewith a metallizable, redox dye-releaser;

(b) a dye image-receiving layer;

(c) an alkaline processing composition and means containing same for discharge within the assemblage, and (d) a transparent cover sheet located over the layer outermost from the support;

the assemblage containing an electron tranfer agent and a sequestering agent which is gluconic acid, $N[CH_2—P(O)(OH)_2]_3$ or $(HO)_2P(O)—C(CH_3)(OH)—P(O)(OH)_2$.

The sequestering agent can be located in any layer of the assemblage as desired. A convenient and preferred location, however, is in the alkaline processing composition.

The sequestering agent can be employed in the assemblage in any concentration which is effective for the intended purpose. When employed in the alkaline processing composition, good results are obtained when the sequestering agent is present at a concentration of from about 1 to about 50 grams per liter of processing composition.

As noted above, one of the sequestering agents employed in the assemblage of the invention is gluconic acid, $HOCH_2—(CHOH)_4—COOH$ (Compound 1). This material may be used either in the free acid form or in a salt form, such as the sodium or potassium salt.

Another of the sequestering agents which can be employed in the assemblage of the invention is $N[CH_2—P(O)(OH)_2]_3$, aminotris(methylenephosphonic acid) (Compound 2). In a preferred embodiment, this material is employed in an aqueous mixture of its pentasodium salt form and its free acid form. This material is available commercially from Monsanto as Dequest® 2006, an aqueous mixture of 40% of the pentasodium salt form and 30% of the free acid form of the aminotris(methylenephosphonic acid).

Another sequestering agent which can be employed in the assemblage of the invention is $(HO)_2P(O)—C(CH_3)(OH)—P(O)(OH)_2$,

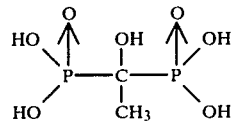

(Compound 3)

This material is available commercially from Monsanto as Dequest® 2010, which is considered to be the free acid form of 1-hydroxyethylidene-1,1-diphosphonic acid.

Any redox dye releaser (RDR) may be employed in this invention as long as it has a metallizable dye moiety. RDR's are well known to those skilled in the art and are, generally speaking, compounds which will react with oxidized or unoxidized developing agent or electron transfer agent to release a dye. The dye moiety of a metallizable RDR contains a metal chelating group such as hydroxy, amino, carboxy, sulfonamido, sulfamoyl, acyl, etc.

In general RDR's include negative-working compounds as described, for example, in U.S. Pat. No. 3,728,113 of Becker et al; U.S. Pat. No. 3,725,062 of Anderson and Lum; U.S. Pat. No. 3,698,897 of Gompf and Lum; U.S. Pat. No. 3,628,952 of Puschel et al; U.S. Pat. No. 3,443,939 and U.S. Pat. No. 3,443,940 of Bloom et al; U.S. Pat. No. 4,053,312 of Fleckenstein; U.S. Pat. No. 4,076,529 of Fleckenstein et al; U.S. Pat. No. 4,055,428 of Koyama et al; U.S. Pat. No. 4,149,892 of Deguchi et al; U.S. Pat. No. 4,198,235 and U.S. Pat. No. 4,179,291 of Vetter et al; *Research Disclosure* 15157, November, 1976 and *Research Disclosure* 15654, April, 1977, the disclosures of which are hereby incorporated by reference.

In general, RDR's also include positive-working compounds (PRDR's). Such PRDR's are disclosed, for example, in U.S. Pat. Nos. 4,139,379, 4,199,354, 4,232,107, 4,242,435, 4,273,855, 3,980,479 and 4,139,389, the disclosures of which are hereby incorporated by reference. In a preferred embodiment of these PRDR's, an immobile compound is employed which as incorporated in a photosensitive element is incapable of releasing a diffusible dye. However, during photographic processing under alkaline conditions, the compound is capable of accepting at least one electron (i.e., being reduced) and thereafter releases a diffusible dye. These immobile compounds are ballasted, electron accepting nucleophilic displacement compounds.

In a preferred embodiment of this invention, the metallizable RDR is a quinone PRDR and the photographic element contains an incorporated reducing agent as described in U.S. Pat. No. 4,139,379, referred to above. In another preferred embodiment, the quinone PRDR's have the formula:

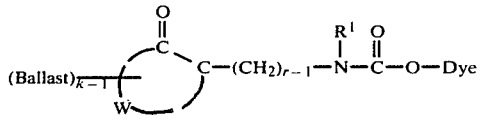

wherein:

Ballast is an organic ballasting radical of such molecular size and configuration as to render the compound nondiffusible in the photographic element during development in an alkaline processing composition;

W represents at least the atoms necessary to complete a quinone nucleus;

r is a positive integer of 1 or 2;

$R^1$ is an alkyl radical having 1 to about 40 carbon atoms or an aryl radical having 6 to about 40 carbon atoms;

k is a positive integer of 1 to 2 and is 2 when $R^1$ is a radical of less than 8 carbon atoms; and Dye is a metallizable organic dye or dye precursor moiety.

Specific metallizable RDR's within the general definition described above, both negative-working and positive-working, are described, for example, in U.S. Pat. No. 4,142,891 of Baigrie et al, U.S. Pat. No. 4,420,550 of Evans et al, U.S. Pat. No. 4,419,435 of Reczek et al, U.S. Pat. No. 4,396,546 of Krutak et al, U.S. Pat. No. 4,368,249 of Anderson et al, U.S. Pat. No. 4,287,292 of Chapman et al, and U.S. Pat. No. 4,165,987 of Green et al, the disclosures of which are hereby incorporated by reference.

Any metal can be employed to metallize the RDR as long as it performs the desired function of forming the metal:dye complex. There can be employed, for example, nickel(II), copper(II), zinc(II), platinum(II), cobalt(II) or cobalt(III). A preferred metal for coordination is nickel(II).

In a preferred embodiment of the invention, the silver halide emulsions employed are the conventional, negative-working emulsions well known to those skilled in the art. A positive image will thereby be obtained in the image-receiving layer. Use of a direct-positive emulsion will produce a negative image in the image-receiving layer. Such a negative can be used to produce positive prints if so desired.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819. In accordance with this embodiment of the invention, the dye image-receiving element would comprise a support having thereon, in sequence, a neutralizing layer, a timing layer and a dye image-receiving layer. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

A format for integral negative-receiver photographic elements in which the present invention is useful is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container, containing an alkaline processing composition including an electron transfer agent (ETA) and an opacifier, is positioned between the top layer and a transparent cover sheet which has thereon, in sequence, a neutralizing layer and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also contains a neutralizing layer and a timing layer underneath the dye image-receiving layer.

In another embodiment of the invention, the neutralizing layer and timing layer are located underneath the photosensitive layer or layers. In that embodiment, the photographic element would comprise a support having thereon, in sequence, a neutralizing layer, a timing layer and at least one photosensitive silver halide emulsion layer having associated therewith a dye image-providing material. A dye image-receiving layer would be provided on a second support with the processing composition being applied therebetween. This format could either be peel-apart or integral, as described above.

A process for producing a photographic transfer image in color according to the invention from an imagewise exposed photosensitive element comprising a support having thereon at least one photosensitive silver halide emulsion layer having associated therewith a dye image-providing material as described above comprises treating the element with an alkaline processing composition in the presence of a silver halide developing agent or ETA to effect development of each of the exposed silver halide emulsion layers. An imagewise distribution of dye image-providing material is thus formed as a function of development, and at least a portion of it diffuses to a dye image-receiving layer to provide the transfer image.

The film unit or assemblage of the present invention is used to produce positive images in single or multicolors. In a three-color system, each silver halide emulsion layer of the film assembly will have associated therewith a dye-releasing compound which releases a dye possessing a predominant spectral absorption within the region of the visible spectrum to which said silver halide emulsion is sensitive, i.e., the blue-sensitive silver halide emulsion layer will have a yellow dye-releaser associated therewith, the green-sensitive silver halide emulsion layer will have a magenta dye-releaser associated therewith and the red-sensitive silver halide emulsion layer will have a cyan dye-releaser associated therewith. The dye-releaser associated with each silver halide emulsion layer is contained either in the silver halide emulsion layer itself or in a layer contiguous to the silver halide emulsion layer, i.e., the dye-releaser can be coated in a separate layer underneath the silver halide emulsion layer with respect to the exposure direction.

The concentration of the dye-releasing compounds that are employed in the present invention can be varied over a wide range, depending upon the particular compound employed and the results desired. For example, a dye-releaser coated in a layer at a concentration of 0.1 to 3 g/m$^2$ has been found to be useful. The dye-releaser can be dispersed in a hydrophilic film-forming natural material or synthetic polymer, such as gelatin, polyvinyl alcohol, etc, which is adapted to be permeated by aqueous alkaline processing composition.

A variety of silver halide developing agents are useful in this invention. Specific examples of developers or ETA's useful in this invention include hydroquinone compounds, aminophenol compounds, catechol compounds, and 3-pyrazolidinone compounds as disclosed in column 16 of U.S. Pat. No. 4,358,527 issued Nov. 9, 1982. A combination of different ETA's, such as those disclosed in U.S. Pat. No. 3,039,869, can also be employed. These ETA's are employed in the liquid processing composition or contained, at least in part, in any layer or layers of the photographic element or film unit to be activated by the alkaline processing composition, such as in the silver halide emulsion layers, the dye image-providing material layers, interlayers, image-receiving layer, etc.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid-and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed together with the dye releaser in gelatin or another aqueous alkaline solution-permeable polymeric binder and are about 0.6 to 7 microns in thickness; and the alkaline solution-permeable polymeric interlayers, e.g., gelatin, are about 0.2 to 5 microns in thickness. Of course, these thicknesses are approximate only and can be modified according to the product desired. The silver halide emulsions and dye releasers may also be coated in separate layers, if desired.

Scavengers for oxidized developing agents can be employed in various interlayers of the photographic elements of the invention. Suitable materials are disclosed on page 83 of the November 1976 edition of *Research Disclosure,* the disclosure of which is hereby incorporated by reference.

Any material is useful as the image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November, 1976 edition of *Research Disclosure,* the disclosure of which is hereby incorporated by reference.

Use of a neutralizing material in the film assemblages of this invention will usually increase the stability of the transferred image. Generally, the neutralizing material will effect a reduction in the pH of the image layer from about 13 or 14 to at least 11 and preferably 5 to 8 within a short time after treatment with alkali. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g, alkali metal hydroxides or carbonates such as sodium hydroxide, sodium carbonate or an amine such as diethylamine, preferably possessing a pH in excess of 11, and also preferably containing a developing agent and a sequestering agent according to the invention, as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of three primary regions of the spectrum can be disposed as a single segmented layer, e.g., as by the use of microvessels as described in Whitmore U.S. Pat. No. 4,362,806 issued Dec. 7, 1982.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

Dye Release

An integral imaging-receiver (IIR) element was prepared by coating the following layers in the order recited on a transparent poly(ethylene terephthalate) film support. Quantities are parenthetically given in grams per square meter, unless otherwise stated.

(1) metal containing layer of nickel sulfate hexahydrate (0.58) and gelatin (1.1);

(2) image-receiving layer of poly(4-vinylpyridine) (2.2) and gelatin (2.2);

(3) reflecting layer of titanium dioxide (17.3) and gelatin (2.6);

(4) opaque layer of carbon black (1.9) and gelatin (1.3);

(5) interlayer of 2,5-didodecylquinone (0.48), 2,5-didodecylhydroquinone (0.65) and gelatin (1.2);

(6) red-sensitive, negative-working silver bromoiodide emulsion (0.48 silver), gelatin (1.8), cyan PRDR (0.69), incorporated reducing agent IRA (0.37), and inhibitor (0.02);

(7) interlayer of 2,5-didodecylquinone (0.48), 2,5-didodecylhydroquinone (0.65) and gelatin (1.2);

(8) green-sensitive, negative-working, silver bromoiodide emulsion (1.4 silver), gelatin (1.6), magenta PRDR (0.53), incorporated reducing agent IRA (0.29), and inhibitor (0.007);

(9) interlayer of gelatin (1.1) and scavenger (0.28);

(10) blue-sensitive, negative-working silver bromoiodide emulsion (1.4 silver), gelatin (2.2), yellow PRDR (0.46), incorporated reducing agent IRA (0.45), and inhibitor (0.007); and

(11) overcoat layer of gelatin (0.98).

CYAN PRDR

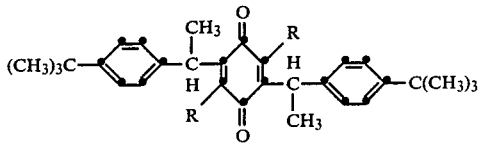

Where R =

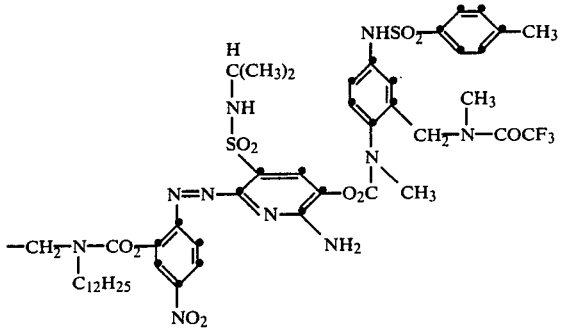

Dispersed in diethyllauramide (PRDR:solvent 2:1)

MAGENTA PRDR

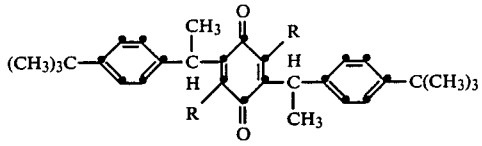

Where R =

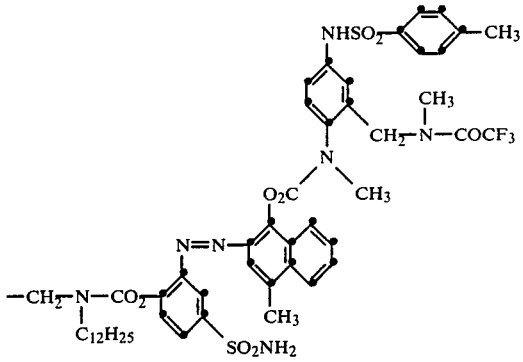

Dispersed in diethyllauramide (PRDR:solvent 1:1)

YELLOW PRDR

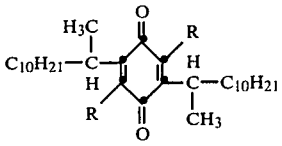

-continued

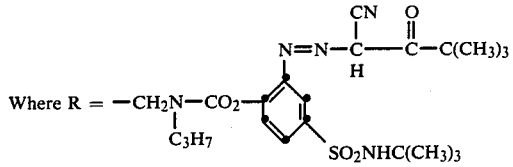

Where R =

Codispersed with IRA and inhibitor in diethyllauramide (total solid:solvent 2:1)

IRA

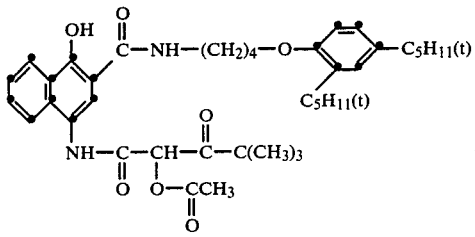

Codispersed with Inhibitor in diethyllauramide (Total solid:solvent 2:1)

INHIBITOR

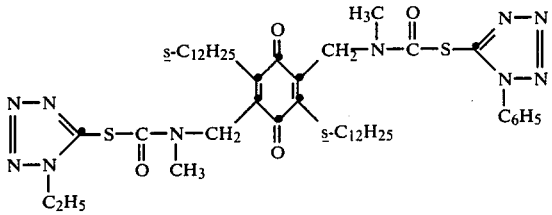

Codispersed with IRA in diethyllauramide (Total solid:solvent 2:1)

SCAVENGER

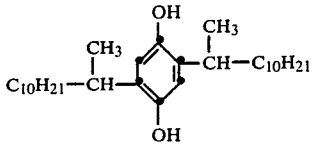

A series of pods differing only in sequestrant were prepared as follows:

60 g/l potassium hydroxide 12 g/l 4-hydroxymethyl-4-methyl-1-p-tolyl-3-pyrazolidinone 5 g/l potassium bromide 35 g/l carboxymethylcellulose sequestrant as indicated in table below.

The above components were used to determine the release rate of the cyan dye using an apparatus designed to rapidly laminate and spread the contents of a processing pod between an IIR and clear polyester cover sheet using a pair of power-driven undercut rollers providing a 75 μm gap. The unexposed laminated unit spread with processing fluid continues its travel upon exiting the rollers and is exposed in sequence through a narrow slit to an electronic flash tube. Because the laminated unit continues to move, each newly exposed area represents a progressively later time from t=0, the time of lamination. After this exposure sequence the laminated unit is allowed to stand for five minutes, peeled apart, washed, and the Status A red reflection density of each area is read.

If no exposure occurs, there is no silver development, no oxidation of the electron transfer agent, no oxidation of the incorporated reducing agent, and all the quinone PRDR is reduced to release dye and yield D-max.

When exposure occurs, rapid silver development is initiated because the unit has been prelaminated with the alkaline pod; the electron transfer agent is oxidized, and the remaining incorporated reducing agent is oxidized thus preventing further dye release from the PRDR. The primary shut-down of the system thus is a function of the time that elapses between lamination and exposure. These times (directly related to the distance of exposure step from the initial lamination point) provide a series of stepped exposures of increasing density. Measurement of the time required to attain a given density, such as D=1.0, is proportional to the release rate of dye from the PRDR. The release rates tabulated below have been obtained in this manner. (There are three experimental groups, A, B, C, each run at different times with equivalent but not identical IIRs). The following results were obtained:

TABLE I

| Sequestering Agent in Pod | g/l in pod | Molar Ratio to EDTA | Release Rate t (sec) for D = 1.0 Group A | Group B | Group C |
|---|---|---|---|---|---|
| None (control) | — | — | >35 | nd | 29 |
| Compound 2 Dequest ® 2006 | 40.9 (acid form) | 2.0 | 27 | 25 | nd |
| Compound 3 Dequest ® 2010 | 23.5 (acid form) | 2.0 | nd | 23 | nd |
| Compound 1 Gluconic acid | 16.0 (K-salt) | 2.0 | 24 | 23 | nd |
| Comparisons | | | | | |
| EDTA | 10.0 (acid form) | (1.0) | 31 | 24 | 21 |
| EONTA | 13.0 (acid form) | 1.0 | nd | nd | 31 |
| Malic acid | 9.2 (acid form) | 2.0 | >35 | nd | nd |
| Glycolic acid | 5.2 (acid form) | 2.0 | >35 | nd | nd |
| Citric acid | 13.0 (acid form) | 2.0 | >35 | nd | nd |
| "12-N" | 12.5 (acid form) | 0.9 | nd | nd | 35 |

nd = not determined

Notes on the Compounds

Compound 2—Dequest ®2006 (Monsanto)

It is considered to be an aqueous mixture of 40% of the pentasodium salt form, and 30% of the free acid form of $N(CH_2P(O)(OH)_2)_3$, aminotris(methylenephosphonic acid).

Compound 3—Dequest ®2010 (Monsanto)

It is considered to be the free acid form of 1-hydroxyethylidene-1,1-diphosphonic acid:

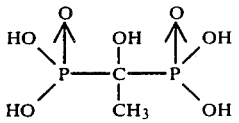

Compound 1, gluconic acid $HOCH_2—(CHOH)_4—COOH$;

EDTA (ethylenediaminetetraacetic acid)

$(HOOCCH_2)_2N—CH_2CH_2—N(CH_2COOH)_2$;

EONTA (ethylenebis[oxyethyleneamine])tetraacetic acid $(HOOCCH_2)_2N(CH_2)_2—O(CH_2)_2O—(CH_2)_2N(CH_2COOH)_2$;

malic acid $HOOC—CHOH—CH_2COOH$;

glycolic acid $HOCH_2—COOH$;

citric acid

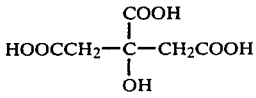

"12-N"

1,4,7,10-tetrazacyclododecane-1,4,7,10-tetraacetic acid

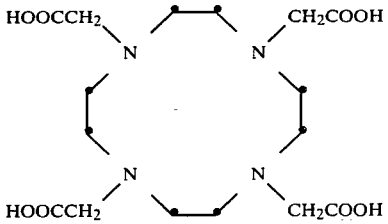

The data of the table indicate that, within experimental error, the sequestering agents of the invention incorporated in the pod release cyan dye from the RDR at least as fast as does the state of the art complexing agent, EDTA. There are other problems with EDTA, however, as will be shown below. Dye release without any sequestering agent is very slow. The use of related hydroxylated carboxylic acids in the pod is also relatively ineffective for dye release.

EXAMPLE 2

Dye Diffusion

This example evaluates the rate of diffusion of the nonmetallized form of a metallizable cyan dye (such as would be released from a quinone PRDR) with different sequestering agents.

An alkaline dye-containing processing composition was prepared as follows:

0.0375 mmole (10.3 mg) of a model cyan dye

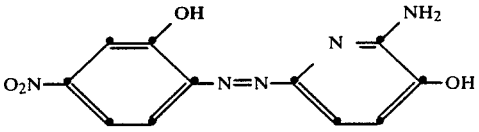

was dissolved in 5 ml of 0.125N aqueous potassium hydroxide to which was added a 10 ml aliquot of a viscous processing solution comprising 38.4 g/l potasium hydroxide and 45 g/l carboxymethylcellulose.

Additional compositions were prepared containing the sequestering agents listed in Table II below. In preparing these compositions, the sequestering agent was dissolved in the 0.125N alkali with the dye before adding the aliquot of the viscous processing solution.

A receiving element was prepared by coating the following layers on a transparent poly(ethyleneterephthalate) film support. Coverages are parenthetically stated in g/m$^2$.

(1) mordant layer of poly(styrene-co-N-benzyl-N,N-dimethyl-N-vinylbenzylammonium chloride-co-divinylbenzene) (2.3) and gelatin (2.3);

(2) reflecting layer of titanium dioxide (16.0) and gelatin (2.6);

(3) opaque layer of carbon (1.9) and gelatin (1.2); and (4) overcoat of gelatin (4.3).

An aliquot of the dye-containing processing composition was spread and laminated between the receiver and a clear polyester cover sheet using a pair of 100 μm undercut rollers. The reflection density of the mordant side of the laminated unit was read at the λ-max of the dye at 10-second intervals until no significant change in density was observed. This data was transformed mathematically to transmission density using a well-established equation. The t-½ was tabulated from this latter data as the time required to reach 50% of the maximum transmission density. The following results were obtained.

TABLE II

| Sequestering Agent in Processing Composition | g/l | Molar Ratio to EDTA | Dye Diffusion t-½ sec |
|---|---|---|---|
| None (control) | — | — | 150–190 |
| Compound 2, Dequest ® 2006 | 2.05 | 0.4 | 27 |
| Compound 3, Dequest ® 2010 | 1.55 | 0.6 | 26 |
| Compound 1, Gluconic acid | 2.73 | 1.0 (as Na salt) | 55 |
| Comparisons | | | |
| EDTA | 5.06 (as dipotassium salt) | 1.0 | 26 (defined) |
| EONTA | 4.75 | 1.0 | 23 |
| Malic acid | 1.68 | 1.0 | 159 |
| Glycolic acid | 0.95 | 1.0 | 159 |
| Citric acid | 2.40 | 1.0 | 118 |
| "12-N" | 5.06 | 1.0 | 28 |

The data indicates that diffusion of the unmetallized cyan dye in the absence of a complexing agent was very slow (t-½ ranged from 150 to 190 seconds). In general, the addition of a sequestering agent improved the diffusion rate. Sequestering agents, Compounds 2 and 3, and comparison compounds, EDTA, EONTA and "12-N" were particularly effective in promoting dye diffusion (t-½ values were less than 30 seconds). There are other problems with these comparison compounds, however, as will be shown below.

EXAMPLE 3

Dye Demetallization

This example illustrates the extent of spectral change for a magenta dye that is believed to undergo demetallization on a mordant receiver.

Dye donor coatings of the following structure were prepared by coating the following layers on a transparent poly(ethylene terephthalate) film support. Coverages are parenthetically stated in g/m$^2$:

(1) acid layer of poly(n-butyl acrylate-co-acrylic acid) (30:70 weight ratio) equivalent to 140 meg acid/m$^2$;

(2) timing layer of a physical mixture of two polymers:

cellulose acetate (40% acetyl) (10.4) and poly(styrene-co-maleic anhydride (50:50 weight ratio) (0.32); and (3) dye-containing layer of magenta PRDR (0.30), IRA of Example 1 (0.29), bis(vinylsulfonyl methyl)ether (0.02) and gelatin (2.2).

Magenta PRDR

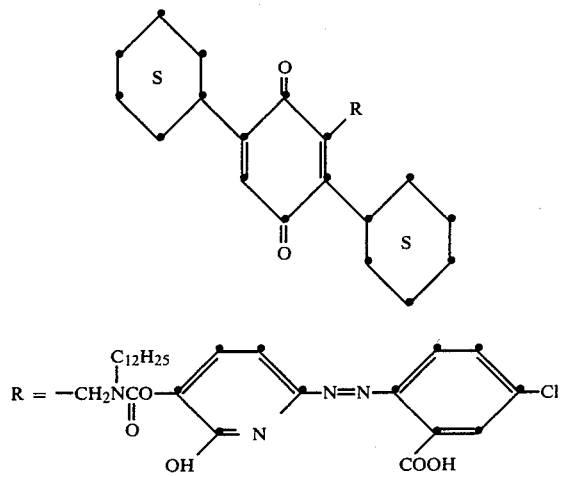

Alkaline processing compositions in a pod were prepared consisting of 51 g/l potassium hydroxide and 42 g/l carboxymethylcellulose with either 10.0 g/l sequestering agent EDTA or 12.8 g/l of Compound 1 gluconic acid.

A receiving element was prepared by coating the following layer on a transparent poly(ethylene terephthalate) film support. Coverages are parenthetically stated in g/m$^2$;

(1) metal-containing layer of nickel sulfate hexahydrate (0.58) and gelatin (1.1);

(2) mordant layer of poly(1-vinylimidazole) (2.2) and gelatin (2.2);

(3) reflecting layer of titanium dioxide (19.0) and gelatin (3.0); and (4) overcoat of gelatin (1.2).

The dye donor coating was laminated to the receiver by spreading of the contents of the pod using a pair of 100 μm undercut rollers. After five minutes the reflection density of the receiver side of the laminated unit was read between 450 and 650 nm. The laminated unit was allowed to stand for 24 hours at room temperature and the reflection density was again read. The following results were obtained:

| Sequestering Agent in Pod | Wavelength λ-max (nm) 5 Min. | 24 hours |
|---|---|---|
| EDTA (control) | 550 | 510 |
| Compound 1, gluconic acid | 550 | 555 |

The above results indicate and examination of the coatings show that with the state of the art EDTA sequestering agent, after 24 hours a large change in hue from magenta to orange occurred. The metallized form of the dye with nickel is magenta, and it is assumed that the EDTA sequestering agent competes with the metal-dye complex for the nickel. As the pH was progressively decreased by the acid and timing layers, the extent of dye demetallization increased.

With gluconic acid in the pod, however, there was very little change in the magenta hue within 24 hours. Gluconic acid is a relatively weak sequestering agent for nickel at the lower pHs, thus the metal-dye complex is able to retain nickel and no hue change occurred.

EXAMPLE 4

Dye Demetallization

This example evaluated demetallization of a model magenta metallized dye on the mordant receiver with different sequestering agents.

Alkaline dye-containing processing compositions were prepared as in Example 2. No sequestering agent was added to the pod. Each pod contained 0.0375 mmole (10.9 mg) of a model magenta dye; this dye is representative of that used for a state of the art quinone PRDR:

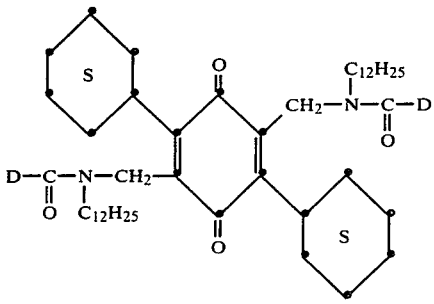

where the dye, D, is:

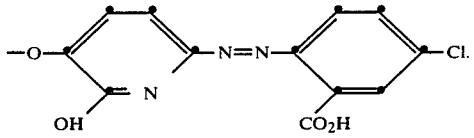

Additional alkaline processing compositions were prepared without dye and containing potassium hydroxide (28 g/l), carboxymethylcellulose (30 g/l), and the indicated sequestering agent in the Table III below.

Receiver I of the following structure was prepared by coating the following layers on a transparent poly(ethylene terephthalate) film support. Coverages are parenthetically stated in g/m$^2$:

(1) metal-containing layer of nickel sulfate hexahydrate (0.58) and gelatin (1.1);

(2) mordant layer of poly(4-vinylpyridine) (2.2) and gelatin (2.2);

(3) reflecting layer of titanium dioxide (16.0) and gelatin (2.6);

(4) opaque layer of carbon (1.9) and gelatin (1.2); and (5) overcoat of gelatin (2.7).

A Receiver II, containing poly(1-vinylimidazole) (2.2) and gelatin (2.2) in the mordant layer, 2, and without an opacifying layer, 4, was also prepared.

A cover sheet was prepared by coating the following layers on a transparent poly(ethylene terephthalate) film support. Coverages are parenthetically stated in g/m$^2$:

(1) acid layer of poly(n-butyl acrylate-co-acrylic acid) (30:70 weight ratio) equivalent to 140 meq acid/m$^2$; and (2) timing layer of a 1:1 physical mixture of the following two polymers coated at 4.8 g/m$^2$:

(1) Poly(acrylonitrile-co-vinylidene chloride-co-acrylic acid) in a weight ratio of 14/79/7 and (2) The carboxy ester lactone formed by cyclization of a vinyl acetate-maleic anhydride copolymer in the presence of 1-butanol to produce a partial butyl ester of acid:ester of 15:85.

An aliquot of the dye-containing processing composition was spread and laminated between each receiver and cover sheet using a pair of 100 μm undercut rollers. After four hours at room temperature, the receiver was peeled from the laminated unit, washed with water, and dried. The receiver was then relaminated to another cover sheet using the non-dye-containing processing composition. These laminated units were held for 24 hours at room temperature and the reflection spectrum of the dye was recorded as the initial reading. The laminated units were then incubated for another 24 hours at 60°/70% RH and the spectrum of each dye was read again. Comparison of the spectra with a known reference of the fully-metallized dye indicated the extent of demetallization. The incubation conditions used represent a severe test and the extent of demetallization is dependent upon the specific dye and mordant used.

Although the exact extent of demetallization cannot be calculated, estimates can be made from the spectral changes and shifts. Terms in the table are defined as:

| | |
|---|---|
| All | at least 90% of the dye is estimated to be in the non-metallized form; |
| Mostly | much more than 50% of the dye is estimated to be in the non-metallized form; |
| Some | much less than 50% of the dye is estimated to be in the non-metallized form; and |
| None | less than 10% of the dye is estimated to be in the non-metallized form. |

The following results were obtained:

TABLE III

| Sequestering Agent in Processing Composition | g/l | Molar Ratio to EDTA | Dye Demetallization Receiver A Initial | Receiver A 24 hr | Receiver B Initial | Receiver B 24 hr |
|---|---|---|---|---|---|---|
| None (control) | — | — | None | None | None | None |
| Compound 2 Dequest ® 2006 | 4.0 | 0.4 | None | None | None | None |
| Compound 3 Dequest ® 2010 | 3.1 | 0.6 | None | None | None | None |
| Compound 1 Gluconic acid | 5.5 | 1.0 | None | None (as Na salt) | None | None |
| Comparisons | | | | | | |
| EDTA | 10.0 | 1.0 | Some | All (defined) | Mostly | All |
| EONTA | 4.8 | 0.5 | None | None | nd | nd |
| Malic acid | 3.4 | 1.0 | None | None | nd | nd |
| Glycolic acid | 1.9 | 1.0 | None | None | nd | nd |
| Citric acid | 4.8 | 1.0 | None | None | nd | nd |
| "12-N" | 4.0 | 0.4 | None | All | None | All |

nd = not determined

The above results indicate that the sequestering agents of the invention are better than EDTA and "12-N" for not demetallizing under the conditions stated.

SUMMARY OF THE EXAMPLES

Each of the examples illustrates a basic concept or one aspect of a multi-faceted problem. Although certain sequestering agents fulfill one or two of the goals, only the three of the invention are considered suitable because they are effective for all three requirements stated earlier. The results of the examples are stated as a comparison to EDTA:

TABLE IV

| Sequestering Agent | Dye Release | Dye Diffusion | Lack of Dye Demetallization | Useful |
|---|---|---|---|---|
| None | Poorer | Poorer | Better | No |
| Compound 2 Dequest ® 2006 | Equal | Equal | Better | Yes |
| Compound 3 Dequest ® 2010 | Equal | Equal | Better | Yes |
| Compound 1 Gluconic acid | Equal | Slightly Poorer | Better | Yes |
| Comparisons | | | | |
| EONTA | Poorer | Equal | Better | No |
| Malic acid | Poorer | Poorer | Better | No |
| Glycolic acid | Poorer | Poorer | Better | No |
| Citric acid | Poorer | Poorer | Better | No |
| "12-N" | Poorer | Equal | Equal | No |

While the invention has been described in detail with particular reference to preferred embodiments, thereof, it will be understood that variations and modifications can be effected within the spirit and scope of the invention.

What is claimed is:

1. In a photographic assemblage comprising:

(a) a photographic element comprising a support having thereon at least one photosensitive silver halide emulsion layer having associated therewith a metallizable redox dye-releaser;

(b) a dye image-receiving layer;

(c) an alkaline processing composition and means containing same for discharge within said assemblage; and (d) a transparent cover sheet located over the layer outermost from said support;

said assemblage containing an electron transfer agent; the improvement wherein said assemblage contains a sequestering agent which is gluconic acid, $N[CH_2—P(O)(OH)_2]_3$ or $(HO)_2P(O)—C(CH_3)(OH)—P(O)(OH)_2$.

2. The assemblage of claim 1 wherein said sequestering agent is present in said alkaline processing composition.

3. The assemblage of claim 2 wherein said sequestering agent is present at a concentration of from about 1 to about 50 grams per liter of processing composition.

4. The assemblage of claim 2 wherein said sequestering agent is an aqueous mixture of the pentasodium salt form and the free acid form of $N[CH_2—P(O)(OH)_2]_3$.

5. The assemblage of claim 2 wherein said sequestering agent is the free acid form of $(HO)_2P(O)—C(CH_3)(OH)—P(O)(OH)_2$.

6. The assemblage of claim 1 wherein said metallizable redox dye-releaser is a positive-working, quinone redox dye-releaser and said photographic element contains an incorporated reducing agent.

7. The assemblage of claim 6 wherein said quinone redox dye-releaser has the formula:

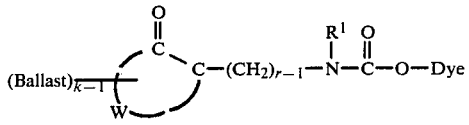

wherein:

Ballast is an organic ballasting radical of such molecular size and configuration as to render said compound nondiffusible in said photographic element during development in said alkaline processing composition;

W represents at least the atoms necessary to complete a quinone nucleus;

r is a positive integer of 1 or 2;

$R^1$ is an alkyl radical having 1 to about 40 carbon atoms or an aryl radical having 6 to about 40 carbon atoms;

k is a positive integer of 1 to 2 and is 2 when $R^1$ is a radical of less than 8 carbon atoms; and Dye is a metallizable organic dye or dye precursor moiety.

8. The assemblage of claim 1 wherein said dye image-receiving layer is located between said support and said silver halide emulsion layer.

9. The assemblage of claim 8 wherein said transparent cover sheet is coated with, in sequence, a neutralizing layer and a timing layer.

10. The assemblage of claim 9 wherein said discharging means is a rupturable container containing said alkaline processing composition and an opacifying agent, said container being so positioned during processing of said assemblage that a compressive force applied to said container will effect a discharge of the container's contents between said cover sheet and the layer outermost from said support.

11. The assemblage of claim 1 wherein said support having thereon said silver halide emulsion layer is opaque, and said dye image-receiving layer is located on said transparent cover sheet and is a dye image-receiving element.

12. The assemblage of claim 11 wherein said dye image-receiving element has thereon, in sequence, a neutralizing layer, a timing layer, and said dye image-receiving layer.

13. The assemblage of claim 11 wherein said opaque support has thereon, in sequence, a neutralizing layer, a timing layer and said silver halide emulsion layer.

14. The assemblage of claim 1 wherein said photographic element comprises a support having thereon a red-sensitive, negative-working, silver halide emulsion layer having a metallizable, ballasted, positive-working, cyan redox dye-releaser associated therewith; a green-sensitive, negative-working, silver halide emulsion layer having a metallizable, ballasted, positive-working, magenta redox dye-releaser associated therewith; and a blue-sensitive, negative-working, silver halide emulsion layer having a ballasted, metallizable, positive-working, yellow redox dye-releaser associated therewith.

15. In an integral photographic assemblage comprising:

(a) a photographic element comprising a transparent support having thereon the following layers in sequence: a dye image-receiving layer; an alkaline solution-permeable, light-reflective layer; an alkaline solution-permeable, opaque layer; a red-sensitive, negative-working, silver halide emulsion layer having a metallizable, ballasted, positive-working, cyan redox dye-releaser associated therewith; a green-sensitive, negative-working, silver halide emulsion layer having a metallizable, ballasted, positive-working, magenta redox dye-releaser associated therewith; and a blue-sensitive, negative-working, silver halide emulsion layer having a metallizable, ballasted, positive-working, yellow redox dye-releaser associated therewith;

(b) a transparent cover sheet superposed over said blue-sensitive silver halide emulsion layer and comprising a transparent support coated with, in sequence, a neutralizing layer and a timing layer; and (c) a rupturable container containing an alkaline processing composition including an electron transfer agent and an opacifying agent, said container being so positioned during processing of said assemblage that a compressive force applied to said container will effect a discharge of the container's contents between said transparent sheet and said blue-sensitive silver halide emulsion layer;

the improvement wherein said assemblage contains a sequestering agent which is gluconic acid, $N[CH_2—P(O)(OH)_2]_3$ or $(HO)_2P(O)—C(CH_3)(OH)—P(O)(OH)_2$.

16. The assemblage of claim 15 wherein said sequestering agent is present in said alkaline processing composition.

17. The assemblage of claim 16 wherein said sequestering agent is present at a concentration of from about 1 to about 50 grams per liter of processing composition.

18. The assemblage of claim 16 wherein said said sequestering agent is an aqueous mixture of the pentasodium salt form and the free acid form of $N[CH_2—P(O)(OH)_2]_3$.

19. The assemblage of claim 16 wherein said sequestering agent is the free acid form of $(HO)_2P(O)—C(CH_3)(OH)—P(O)(OH)_2$.

20. The assemblage of claim 15 wherein each said metallizable redox dye-releaser is a positive-working, quinone redox dye-releaser and said photographic element contains an incorporated reducing agent.

21. The assemblage of claim 20 wherein said quinone redox dye-releaser has the formula:

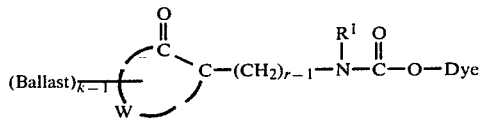

wherein:

Ballast is an organic ballasting radical of such molecular size and configuration as to render said compound nondiffusible in said photographic element during development in said alkaline processing composition;

W represents at least the atoms necessary to complete a quinone nucleus;

r is a positive integer of 1 or 2;

$R^1$ is an alkyl radical having 1 to about 40 carbon atoms or an aryl radical having 6 to about 40 carbon atoms;

k is a positive integer of 1 to 2 and is 2 when $R^1$ is a radical of less than 8 carbon atoms; and Dye is a metallizable organic dye or dye precursor moiety.

* * * * *